US009997879B2

(12) United States Patent
Zhang et al.

(10) Patent No.: US 9,997,879 B2
(45) Date of Patent: Jun. 12, 2018

(54) CABLE CONNECTOR ASSEMBLY WITH DUAL PORTS

(71) Applicant: FOXCONN INTERCONNECT TECHNOLOGY LIMITED, Grand Cayman (KY)

(72) Inventors: Cheng Zhang, Kunshan (CN); Xiao Fan, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/408,447

(22) Filed: Jan. 18, 2017

(65) Prior Publication Data

US 2017/0214200 A1 Jul. 27, 2017

(30) Foreign Application Priority Data

Jan. 25, 2016 (CN) ..... 2016 2 0064886 U

(51) Int. Cl.

| | |
|---|---|
| ***H01R 13/64*** | (2006.01) |
| ***H01R 27/02*** | (2006.01) |
| ***H01R 13/6581*** | (2011.01) |
| ***H01R 13/6598*** | (2011.01) |
| ***H01R 24/22*** | (2011.01) |
| *H01R 107/00* | (2006.01) |

(52) U.S. Cl.

CPC ..... *H01R 27/02* (2013.01); *H01R 13/6581* (2013.01); *H01R 13/6598* (2013.01); *H01R 24/22* (2013.01); *H01R 2107/00* (2013.01)

(58) Field of Classification Search

CPC ..... H01R 27/02
USPC ..... 439/246
See application file for complete search history.

(56) References Cited

U.S. PATENT DOCUMENTS

| | | | | |
|---|---|---|---|---|
| 6,210,216 | B1 * | 4/2001 | Tso-Chin | H01R 13/748 439/545 |
| 6,699,074 | B1 * | 3/2004 | Wu | H01R 13/659 439/607.08 |
| 8,011,961 | B2 * | 9/2011 | Liu | H01R 4/64 439/607.58 |
| 8,277,251 | B2 * | 10/2012 | Liu | H01R 13/504 439/607.04 |
| 8,430,692 | B2 * | 4/2013 | Peng | H01R 13/518 439/607.46 |
| 8,579,519 | B2 * | 11/2013 | Wu | G02B 6/3817 385/101 |

(Continued)

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

An electrical connector assembly includes a housing shroud enclosing the respective first and second connectors spaced and distinct from each other with the corresponding ports exposed outside of the housing shroud. A cable is connected to the first connector and the second connector respectively and extends out of the housing shroud opposite to the mating ports. The first connector is fixed within the housing shroud while the second connector is disposed in the housing shroud in a floating manner wherein the second connector is equipped with a rubber ring transversely confronting the housing shroud for obtaining the floating effect.

15 Claims, 15 Drawing Sheets

(56) References Cited

U.S. PATENT DOCUMENTS

| | | | | |
|---|---|---|---|---|
| 8,632,351 | B2 * | 1/2014 | Wu | H01R 13/6315 439/248 |
| 2009/0317999 | A1 * | 12/2009 | Arts | H01R 13/6315 439/248 |
| 2012/0064762 | A1 * | 3/2012 | Muroi | H01R 9/038 439/578 |
| 2012/0115359 | A1 * | 5/2012 | Ko | H01R 27/02 439/578 |
| 2012/0214326 | A1 | 8/2012 | Ko et al. | |
| 2013/0288081 | A1 * | 10/2013 | Cheng | H01M 2/204 429/7 |

* cited by examiner

CABLE CONNECTOR ASSEMBLY WITH DUAL PORTS

BACKGROUND OF THE INVENTION

1. Field of the Invention

The present invention relates to an electrical plug connector assembly, and particularly to the electrical connector assembly having two respective plug connector units thereof.

2. Description of Related Art

U.S. Pat. No. 8,632,351 issued on Jan. 21, 2014 discloses a plug connector assembly having a housing shroud enclosing the first connector and the second connector which are spaced and distinct from each other with corresponding first and second mating ports respectively exposed outside of the housing shroud. A cable is respectively connected to the first connector and the second connector and extends out of the housing shroud opposite to the mating ports. Practically, on one hand, it is required to have the first mating port and the second mating port somewhat or slightly moveable relative to each other for compromising the manufacturing tolerance. Otherwise, it is relatively hard to have both the first and second mating ports simultaneously both precisely mated with the complementary receptacle mating ports, respectively, without inducing the improper forces thereon. On the other hand, because in the plug connector assembly it requires to have the respectively mating ports properly intimate contact the interior metallic shielding case for avoiding EMI (Electron-Magnetic Interference), such a relative movement may jeopardize the desired shielding effect. Notably, U.S. Pat. No. 8,632,351 discloses use of the resilient member supportably located beside one connector to provide a stable floating effect on the corresponding connector. Anyhow, such arrangement still fails to provide the preferable shielding effect thereabouts. In addition, the resilient member requiring the metallic material and the stamping and forming making procedure, is relatively expensive.

Therefore, a low cost way including the material and the labor, is desired.

SUMMARY OF THE INVENTION

An electrical connector assembly includes a housing shroud enclosing the respective first and second connectors spaced and distinct from each other with the corresponding ports exposed outside of the housing shroud. A cable is connected to the first connector and the second connector respectively and extends out of the housing shroud opposite to the mating ports. The first connector is fixed within the housing shroud while the second connector is disposed in the housing shroud in a floating manner wherein the second connector is equipped with a rubber ring transversely confronting the housing shroud for obtaining the floating effect.

Other optional features may include the followings. The electrical connector assembly further includes a metallic shielding case to shield the connection joint between the respective first/second connector and the cable. The connection joint includes a printed circuit board linked between the first connector and the cable. The shielding case has a front opening relative larger than a cross-sectional dimension of the second connector so as to allow the second connector to be moveable transversely in a floating manner. A conductive sponge surrounds the second connector and intimately shield the front opening in a compressed manner for not only covering the front opening in a front-to-back direction but also preventing any possible gap between the conductive sponge and the shielding case in the front-to-back direction. The second connector includes a conductive outer shell which is electrically connected to the shielding case via the conductive sponge. The shielding case includes an upper case and a lower case. The rubber ring may be pressed in the vertical direction so as to restrict the vertical movement of the corresponding second connector so the electrical connector is moveable in a transverse direction only. The first connector may be USB (Universal Serial Bus) Type C while the second connector is a DC (Direct Current) power connector. The center axis of the cable is aligned with a centerline of the first connector.

Compared with the aforementioned prior art, the invention uses a rubber ring surrounding the second connector to provide a simple and low cost floating effect for compromising the possible deviation of the second connector with respect to the first connector during mating wherein a conductive sponge may be further provided behind the rubber ring but in front of the shielding case in a compressed manner for not only covering the front opening of the metallic shielding case but also sealing the gap between the shielding case and the conductive sponge so as to achieve the preferable EMI shielding effect.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
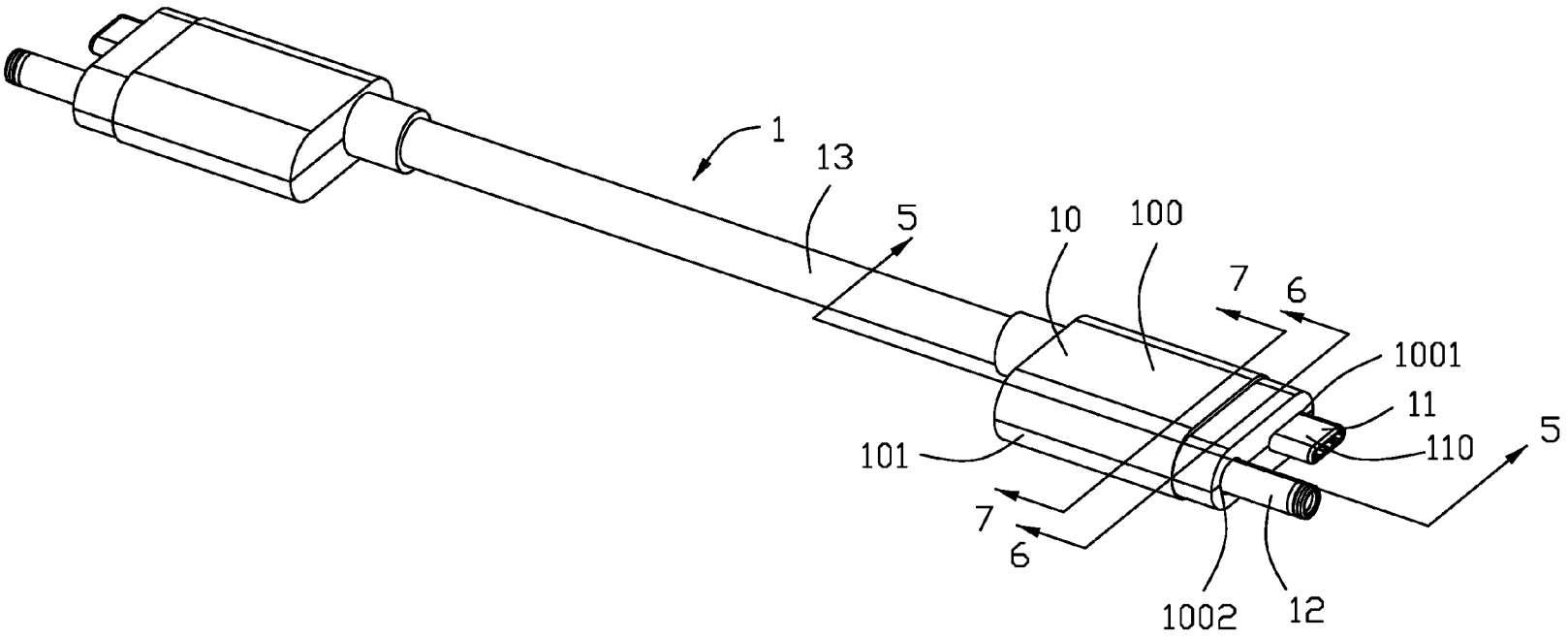
FIG. 1 is an assembled perspective view of an electrical connector assembly according to the presently preferred embodiment of the invention.
Figure 2:
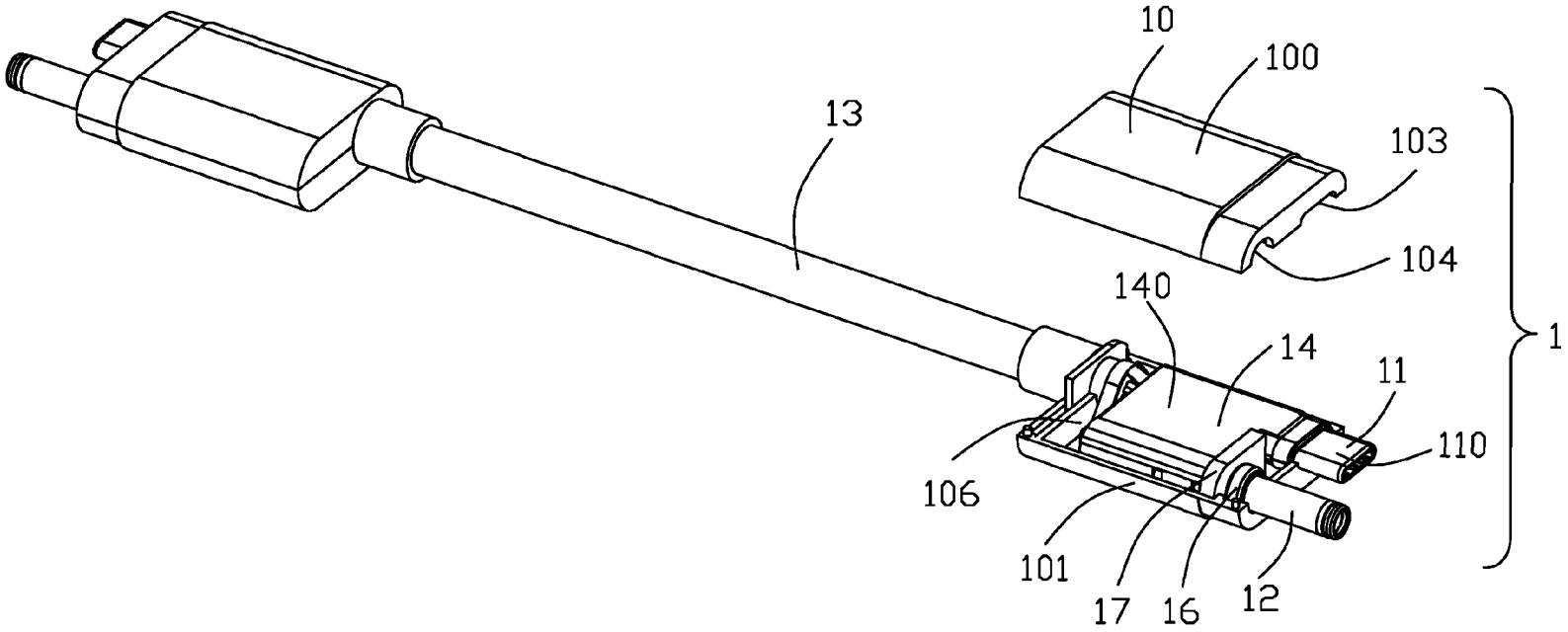
FIG. 2 is a perspective view of the electrical connector assembly of FIG. 1 with the upper part of the housing shroud is removed away therefrom.
Figure 3:
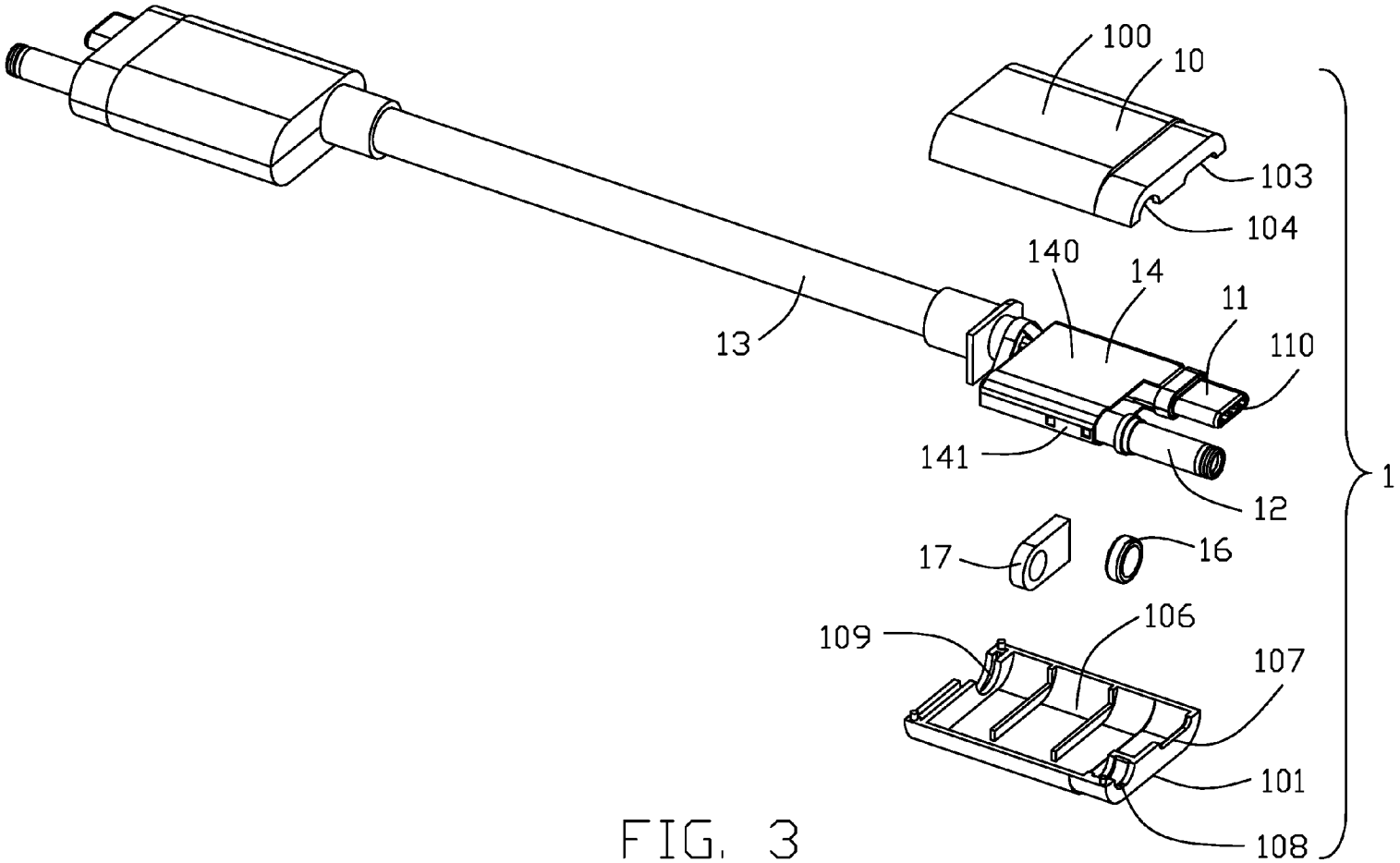
FIG. 3 is an exploded perspective view of the electrical connector assembly of FIG. 1.
Figure 4:
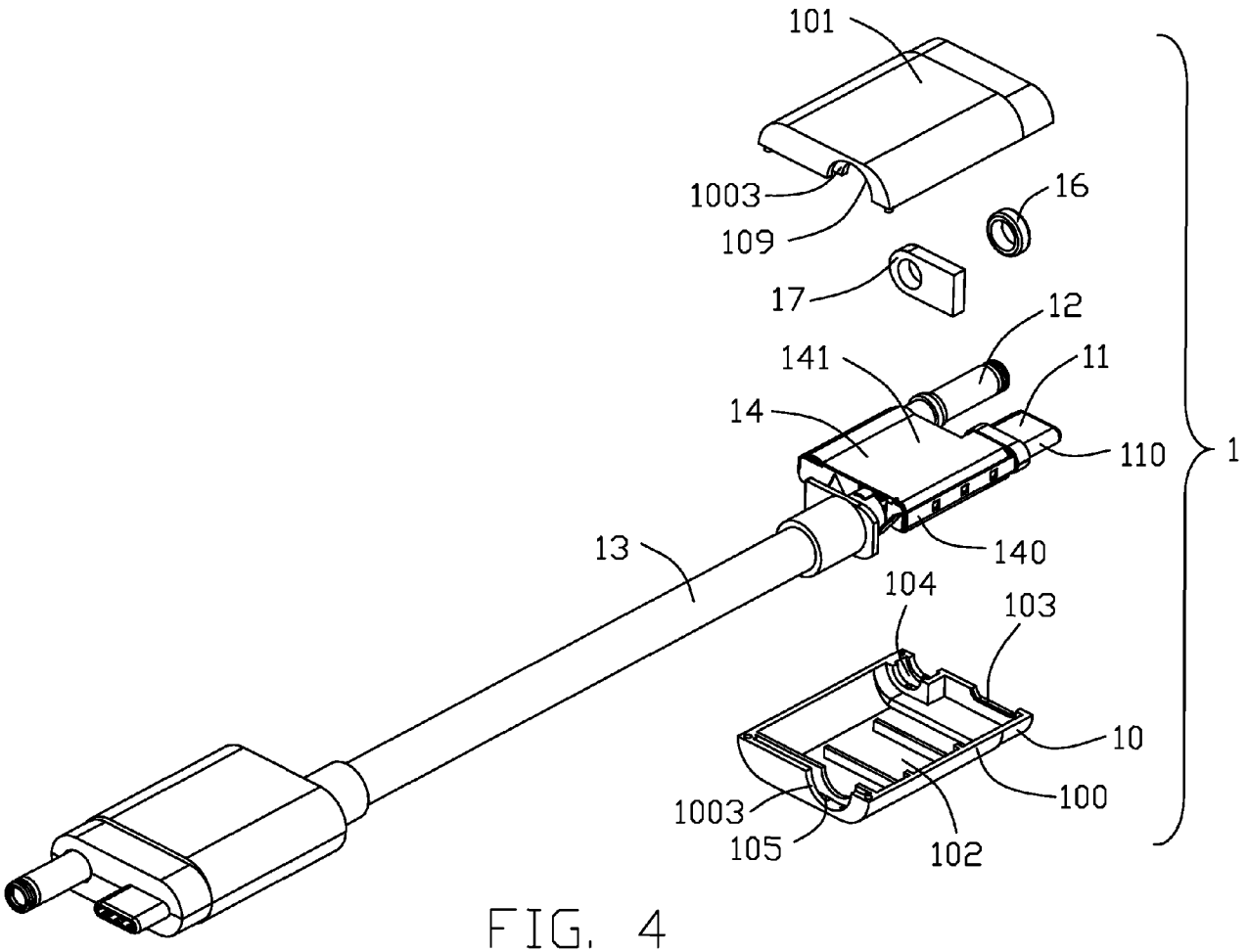
FIG. 4 is another exploded perspective view of the electrical connector assembly of FIG. 3.
Figure 5:
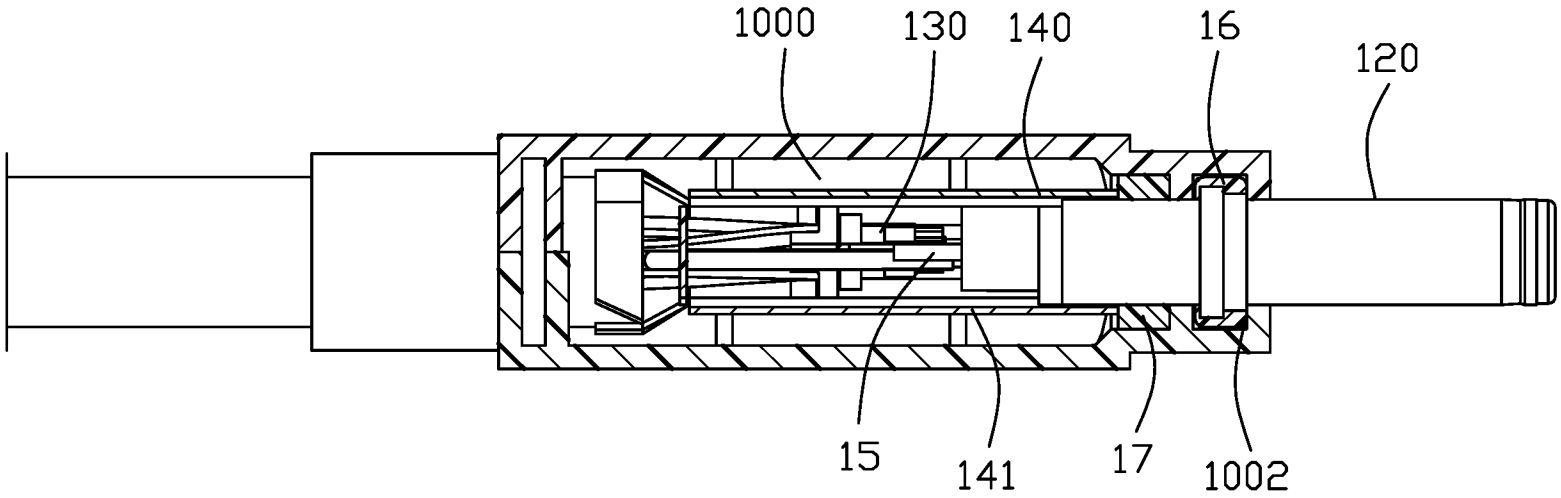
FIG. 5 is a cross-sectional view of the electrical connector assembly taken along line 5-5 in FIG. 1.
Figure 6:
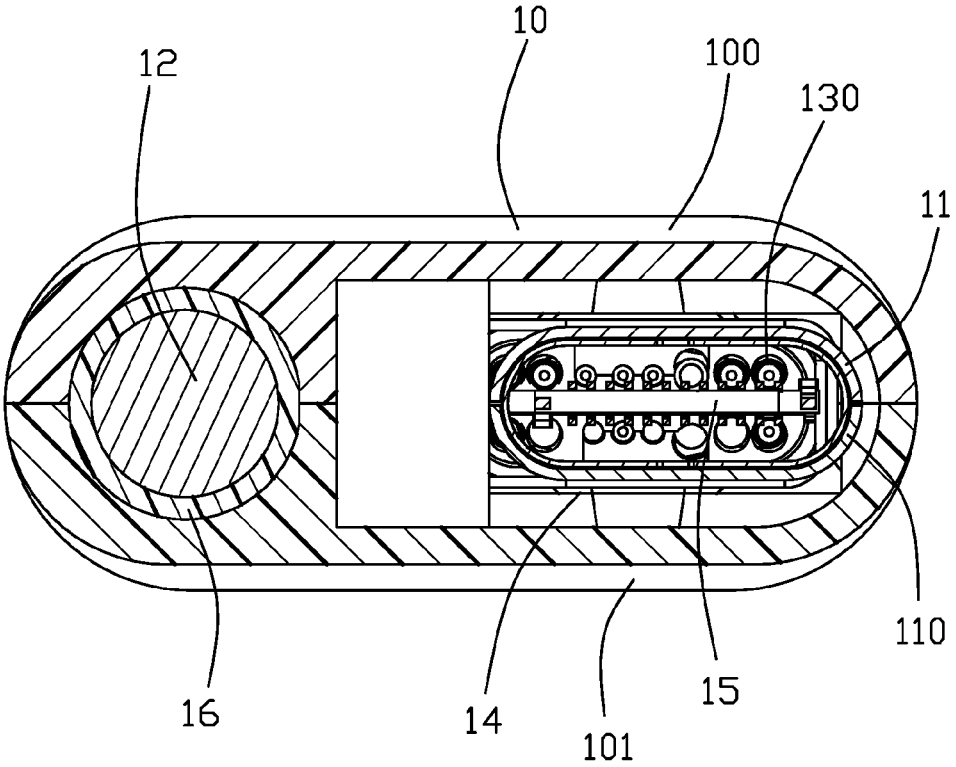
FIG. 6 is a cross-sectional view of the electrical connector assembly taken along line 6-6 in FIG. 1.
Figure 7:
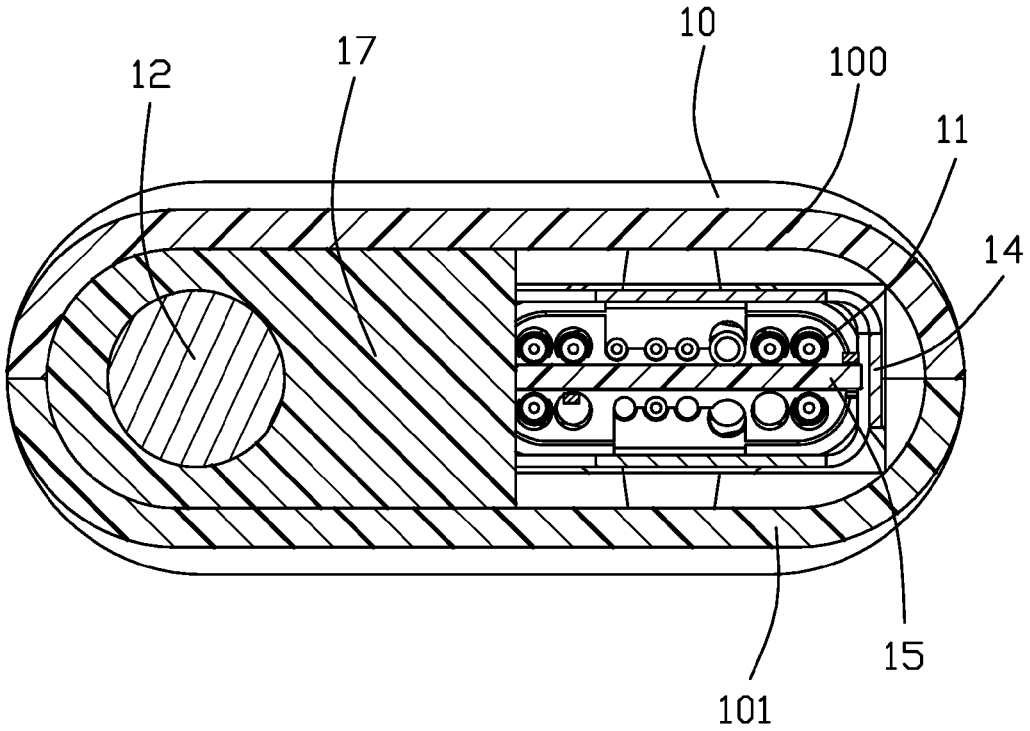
FIG. 7 is a cross-sectional view of the electrical connector assembly taken along line 7-7 in FIG. 1.
Figure 8:
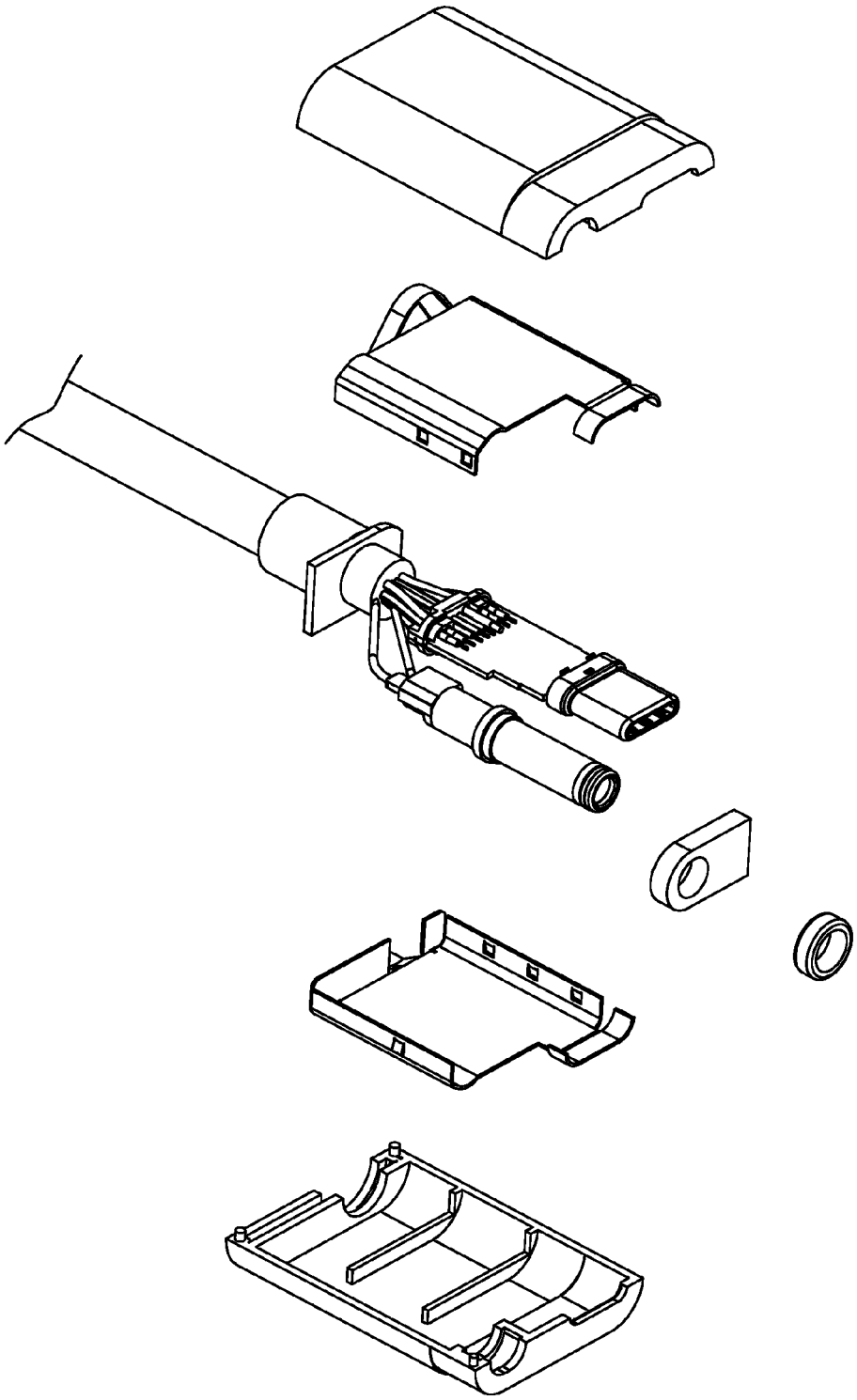
FIG. 8 is a further exploded perspective view of the electrical connector assembly of FIG. 3.
Figure 9:
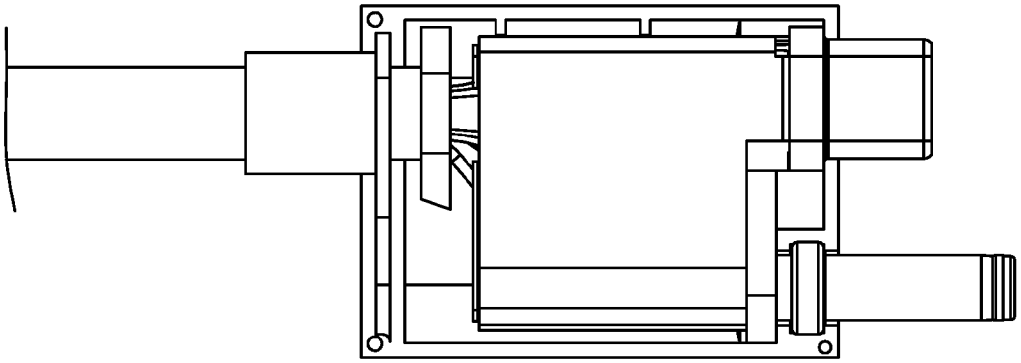
FIG. 9 is a top view of the electrical connector assembly of FIG. 1.

Referring to FIGS. 1-9, a (plug) electrical connector assembly includes an electrical connector assembly 1 including a housing shroud 10, a first connector 11 and a second connector 12 both partially received within the housing shroud 10 and spaced and distinct from each other in a transverse direction with corresponding mating ports (not labeled) exposed outside of the housing shroud 10 in a front-to-back direction perpendicular to the transverse direction, and a cable 13 electrically connected to the first connector 11 and the second connector 12 and extending rearwardly out of the housing shroud 10 opposite to the mating ports, and a metallic shielding case 14 enclosed within the housing shroud 10. The metallic shielding case 14 covers the connection joint between the cable 13 and the respective first and second connectors 11, 12. The first connector 11 is secured within the housing shroud 10 while the second connector 12 is moveable disposed in the housing shroud 10 in a floating manner thus having a greater flexibility to compromise the relatively large manufacturing tolerance when mated with a complementary receptacle connector assembly (not shown) if the distance between the first connector 11 and the second connector 12 in the transverse direction is somewhat different from that between the corresponding mated connectors of the receptacle connector assembly. A printed circuit board 15 is located in the shielding case 14, via which the cable 13 is connected with the corresponding first connector 11 and second connector 12. The second connector 12 is equipped with a rubber ring 16 to provide a transverse floating effect thereabouts, and a conductive sponge 17 between the second connector 12 and the shielding case 14 for filling the gap therebetween. The first connector 11 complies with USB Type C specification for the high speed transmission around 10 G/s and includes a conductive shell 110 exposed as a mating port, while the second connector 12 is a DC power plug.

The housing shroud 1 includes an upper part 100 and the lower part 101 coupled with the upper part 100. The upper part 100 includes an upper space 102, a first upper groove 103 communicating with the upper space 102, a second upper groove 104 communicating with the upper space 102 and side by side arranged with regard to the first upper groove 103, and a third upper groove 105 communicating with the upper space 102 and opposite to the first upper groove 103. The lower part 101 includes a lower space 106, a first lower groove 107 communicating with the lower space 106, a second lower groove 108 communicating with the lower space 106 and side by side arranged with regard to the first lower groove, and a third lower groove 109 communicating with the lower space 106 and opposite to the first lower groove 107. When the upper part 100 and the lower part 101 are coupled together, the upper space 102 and the lower space 106 commonly form a receiving space 1000 of the shielding case 13 wherein the first upper groove 103 and the first lower groove 107 commonly form a first receiving groove 1001 for receiving the first connector 11, the second upper groove 104 and the second lower groove 108 commonly form a second receiving groove 1002 for receiving the second connector 12, and the third upper groove 104 and the third lower groove 109 commonly form a third receiving groove 1003 for receiving the cable 13. The first connector 11 extends through the first receiving groove 1001 out of the housing shroud 10 for mating with one complementary connector, the second connector 12 extends through the second receiving groove 1002 out of the housing shroud 10 for mating with another complementary connector. In this embodiment, the rubber ring 16 is already compressed in the vertical direction while relaxed in the transverse direction so as to be slight movable in the transverse direction.

The cable 13 includes a plurality of wires 130 of two groups, of which one is connected to the first connector 11 and the other is connected to the second connector 12 wherein the wires 130 are connected to the first connector 11 via the printed circuit board 15 while the wires 130 is directly connected to the second connector 12. The printed circuit board 15 is completely received within the shielding case 14 which essentially encloses the connection portion of the cable 13 and the corresponding first connector 11 and second connector 12. In this embodiment, the cable 13 extends rearwardly in a single manner wherein the cable 13 is aligned with the centerline of the first connector 11 in the front-to-back direction for facilitating assembling.

The shielding case 14 includes an upper half 140 and the lower half 141 coupled with the upper half 140. The shielding case 140 may leave some gap beside the second connector 12 for allowing transverse movement of the second connector 12. The conductive sponge 17 surrounds the second connector 12 and located behind the rubber ring 16 while in front of the shielding case 14 for covering the aforementioned gap which is designed for compromising the possible transverse movement of the second connector 12, thus not only allowing the transverse movability of the second connector 12 but also preventing EMI (Electro-Magnetic Interference) from invading the interior of the shielding case 14 through the gap. The second connector 12 includes a conductive shell 120 electrically connected to the shielding case 14 via the conductive sponge 17 so as to assure a constant/continuous shielding effect disregarding which position the second connector 12 is deviated to. The shielding case 14 may be further provided with the metallic foil or other shielding piece for shielding other gaps against EMI.

Figure 10:
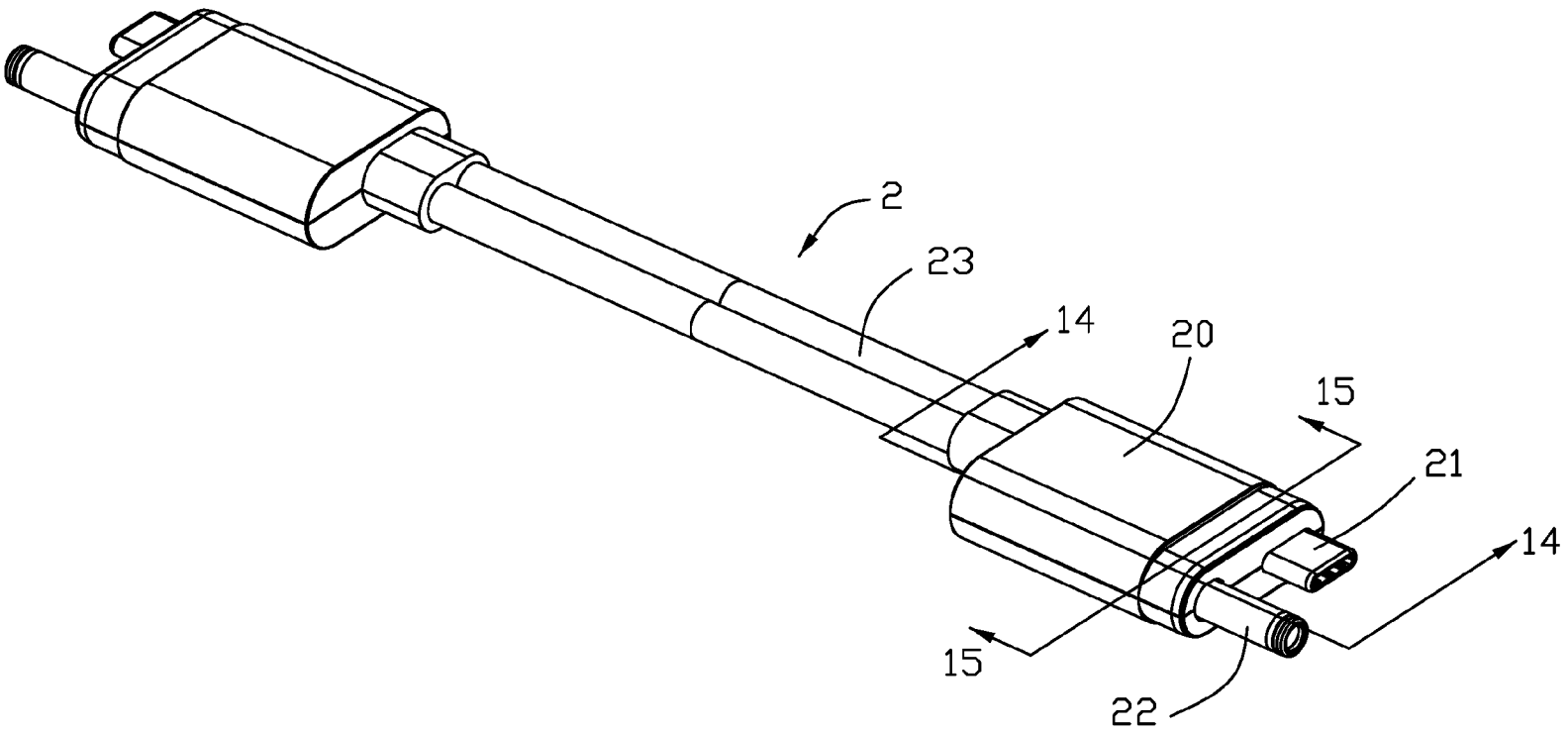
FIG. 10 is an assembled perspective view of an electrical connector assembly according to another presently preferred embodiment of the invention.
Figure 11:
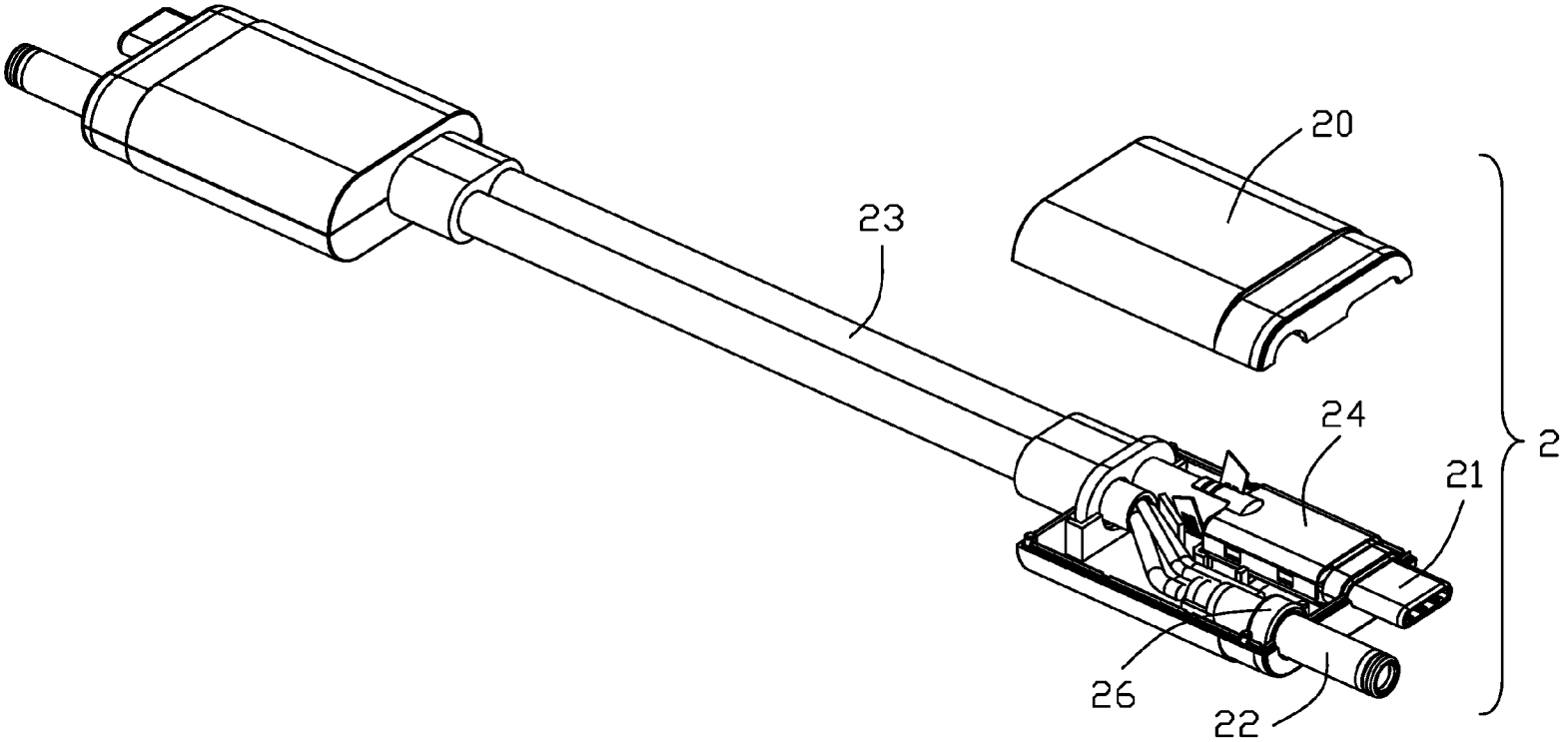
FIG. 11 is a perspective view of the electrical connector assembly of FIG. 10 with the upper part of the housing shroud is removed away therefrom.
Figure 12:
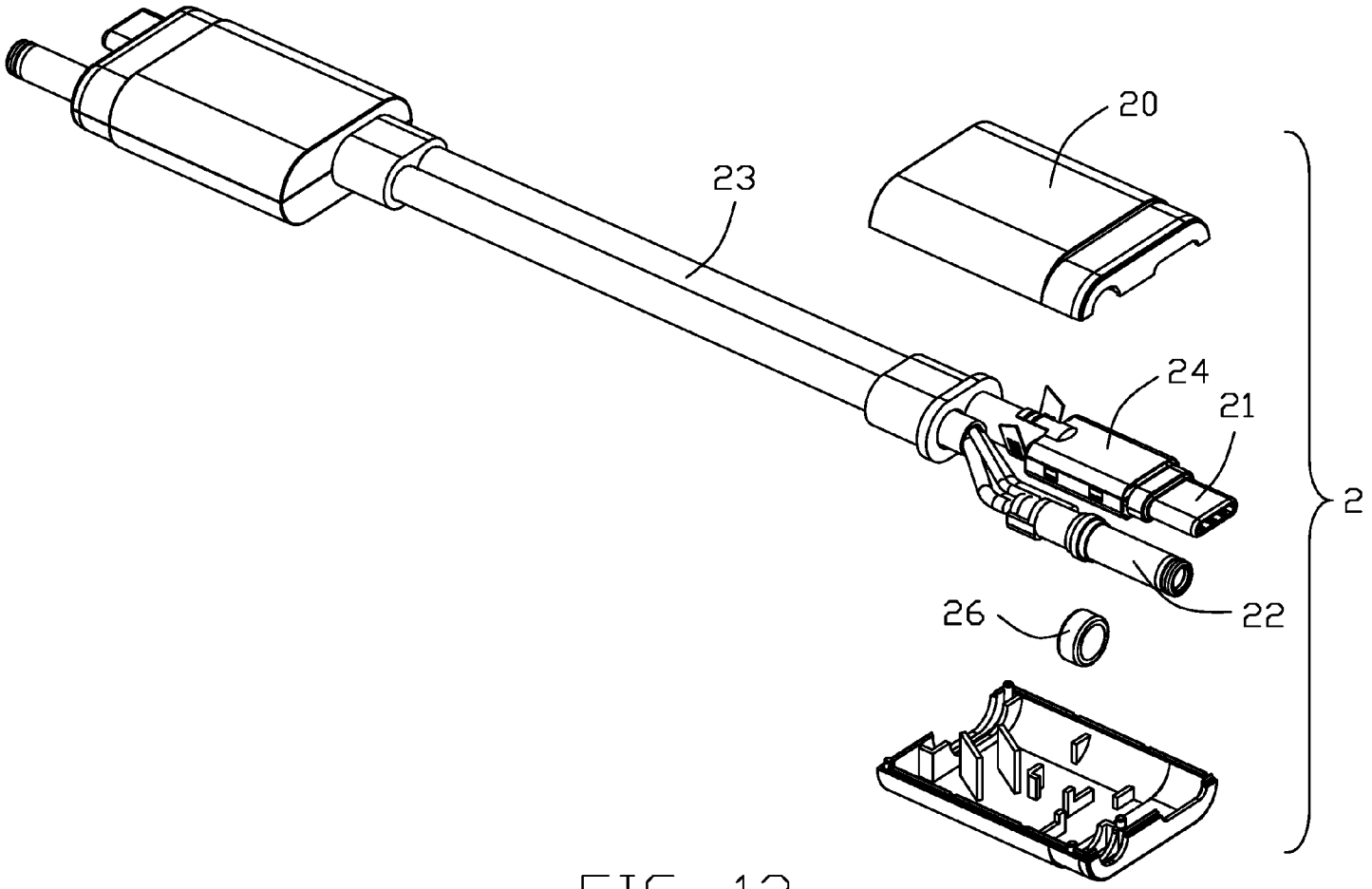
FIG. 12 is an exploded perspective view of the electrical connector assembly of FIG. 10.
Figure 13:
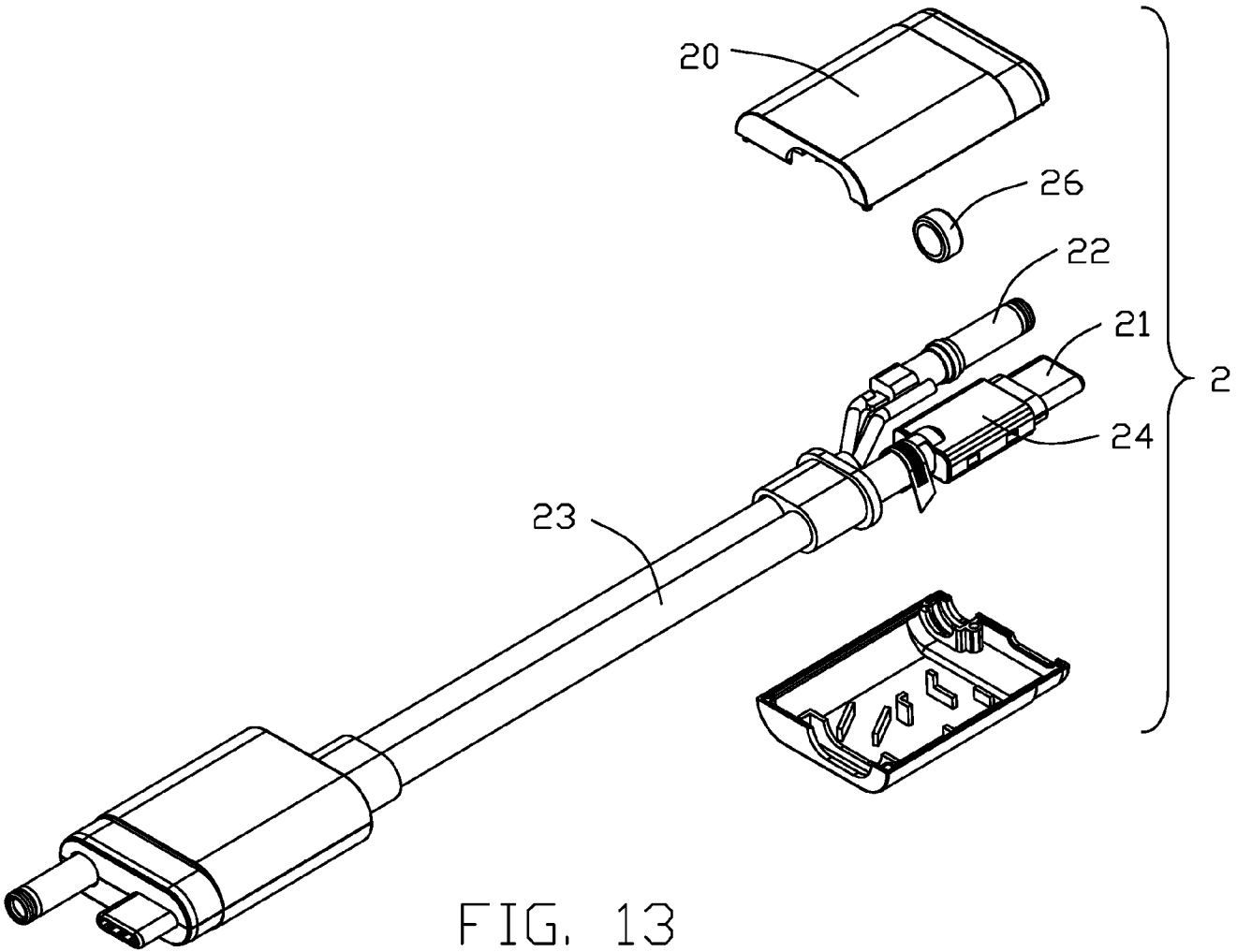
FIG. 13 is another exploded perspective view of the electrical connector assembly of FIG. 10.
Figure 14:
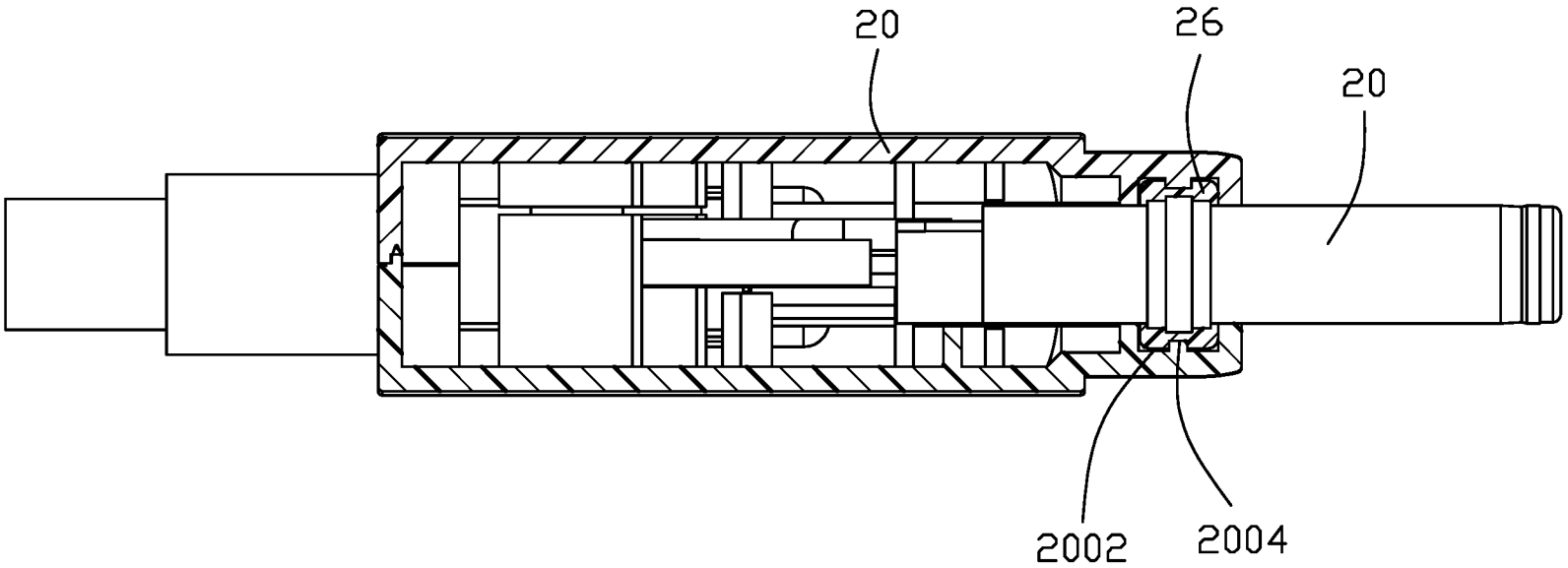
FIG. 14 is a cross-sectional view of the electrical connector assembly taken along line 14-14 in FIG. 10.
Figure 15:
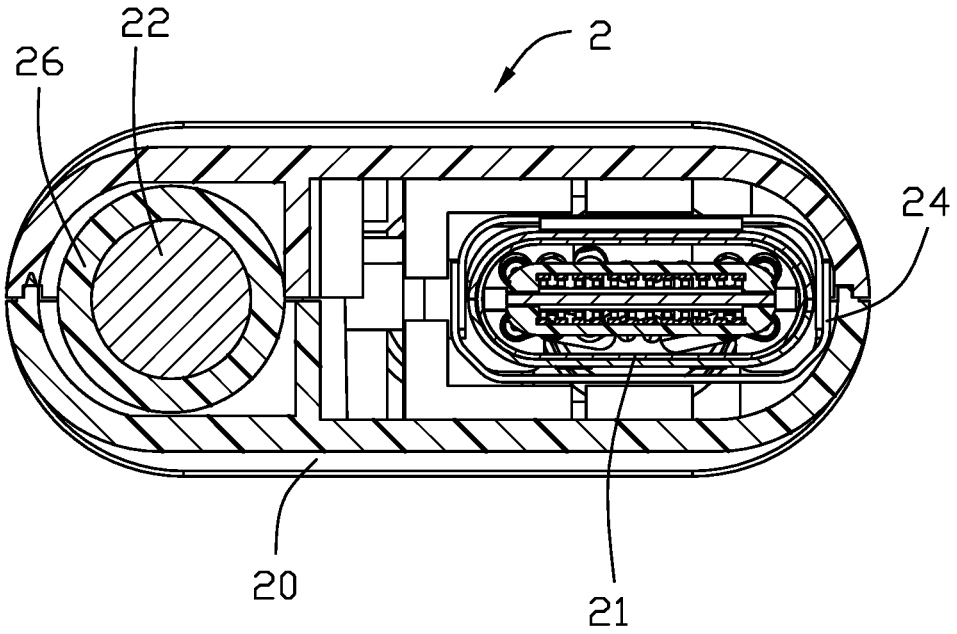
FIG. 15 is a cross-sectional view of the electrical connector assembly taken along line 15-15 in FIG. 10.

Referring to FIGS. 10-15, in the second embodiment similar to the electrical connector assembly 1, the plug connector assembly 2 has the similar structure while the cable 23 includes two strands of which one is connected to the first connector 21 and the other is connected to the second connector 22. The shielding case 24 in the housing shroud 20 only encloses the first connector 21, thus requiring no space for allow moveability of the second connector 22, and no conductor sponge accordingly. The second receiving groove 2002 forms protrusions 2004 to compress the rubber ring 26 in the vertical direction, thus only allowing the second connector 22 to slightly move in the transverse direction.

In brief, in the electrical connector assembly 1, 2, the second connector 12, 22 is equipped with rubber ring 16, 26 so as to provide a floating effect for adjusting the position of the second connector 12, 22 relative to the first connector 11, 21, thus allowing a larger manufacturing tolerance advantageously.

However, the disclosure is illustrative only, changes may be made in detail, especially in matter of shape, size, and arrangement of sections within the principles of the invention.

What is claimed is:

1. An electrical connector assembly comprising:

a housing shroud forming a receiving space between opposite first and second ends in a longitudinal direction, a first receiving groove and a second receiving groove located at the first end and side by side arranged with each other in a transverse direction perpendicular to said longitudinal direction, a third receiving groove formed at the second end;

a first connector received in the receiving space and snugly extending through the first receiving groove;

a rubber ring, through which a second connector extends snugly, disposed in the second receiving groove;

a metallic shielding case disposed in the receiving space to accommodate both the first connector and the second connector; and a conductive sponge filling gaps between the second connector and the metallic shielding case in a compressed manner; wherein the second connector is received in the receiving space and slightly moveable relative to the first connector in said transverse direction due deformation of the rubber ring so as to allow a larger tolerance to compromise the distance between the first connector and the second connector in the transverse direction; and said conductive sponge is located behind the rubber ring and spaced from the rubber ring in the longitudinal direction.

2. The electrical connector assembly as claimed in claim 1, wherein said conductive sponge surrounds said second connector.

3. The electrical connector assembly as claimed in claim 1, wherein said second connector includes a metallic shell which indirectly electrically connects to the shielding case via said conductive sponge.

4. The electrical connector assembly as claimed in claim 1, wherein said first receiving groove is generally aligned with the third receiving groove in the longitudinal direction.

5. The electrical connector assembly as claimed in claim 1, wherein a cable extends outwardly through the third receiving groove.

6. An electrical connector assembly comprising:

a housing shroud forming a receiving space between opposite first and second ends in a longitudinal direction, a first receiving groove and a second receiving groove located at the first end and side by side arranged with each other in a transverse direction perpendicular to said longitudinal direction, a third receiving groove formed in the housing shroud except at the first end;

a first connector received in the receiving space and snugly extending through the first receiving groove;

a rubber ring, through which a second connector extends snugly, disposed in the second receiving groove;

a metallic shielding case is disposed in the receiving space to accommodate both the first connector and the second connector; and a conductive sponge filling gaps between the second connector and the metallic shielding case in a compressed manner; wherein the second connector is received in the receiving space and slightly moveable relative to the first connector in said transverse direction due deformation of the rubber ring so as to allow a larger tolerance to compromise the distance between the first connector and the second connector in the transverse direction; and said second connector includes a metallic shell which indirectly electrically connects to the shielding case via said conductive sponge.

7. The electrical connector assembly as claimed in claim 6, wherein said conductive sponge is located behind the rubber ring and spaced from the rubber ring in the longitudinal direction.

8. The electrical connector assembly as claimed in claim 6, wherein said conductive sponge surrounds said second connector.

9. The electrical connector assembly as claimed in claim 6, wherein said first receiving groove is generally aligned with the third receiving groove in the longitudinal direction.

10. The electrical connector assembly as claimed in claim 6, wherein a cable extends outwardly through the third receiving groove.

11. An electrical connector assembly comprising:

a housing shroud forming a receiving space between opposite first and second ends in a longitudinal direction, a first receiving groove and a second receiving groove located at the first end and side by side arranged with each other in a transverse direction perpendicular to said longitudinal direction, a third receiving groove formed at the second end;

a first connector received in the receiving space and snugly extending through the first receiving groove;

a rubber ring, through which a second connector extends snugly, disposed in the second receiving groove;

a metallic shielding case disposed in the receiving space to accommodate both the first connector and the second connector; and a conductive sponge filling gaps between the second connector and the metallic shielding case in a compressed manner; wherein the second connector is received in the receiving space and slightly moveable relative to the first connector in said transverse direction due to deformation of the rubber ring so as to allow a larger tolerance to compromise a distance between the first connector and the second connector in the transverse direction; and said conductive sponge surrounds said second connector.

12. The electrical connector assembly as claimed in claim 11, wherein said conductive sponge is located behind the rubber ring and spaced from the rubber ring in the longitudinal direction.

13. The electrical connector assembly as claimed in claim 11, wherein said second connector includes a metallic shell which indirectly electrically connects to the shielding case via said conductive sponge.

14. The electrical connector assembly as claimed in claim 11, wherein said first receiving groove is generally aligned with the third receiving groove in the longitudinal direction.

15. The electrical connector assembly as claimed in claim 11, wherein a cable extends outwardly through the third receiving groove.

* * * * *